United States Patent [19]

Recasens

[11] Patent Number: 4,641,589

[45] Date of Patent: Feb. 10, 1987

[54] PROCESS FOR THE RAPID ASSEMBLY OF ELEMENTS COMPOSING A STRUCTURE

[75] Inventor: Joseph Recasens, Sorgues, France

[73] Assignee: Societe Europeenne des Produits Refractaires, Courbevoie, France

[21] Appl. No.: 704,916

[22] Filed: Feb. 25, 1985

[30] Foreign Application Priority Data

Feb. 27, 1984 [FR] France ..... 84 02935

[51] Int. Cl.[4] ..... F23B 7/00

[52] U.S. Cl. ..... 110/341; 52/127.1; 52/127.2; 52/127.5; 52/745; 52/DIG. 1; 110/335; 269/243

[58] Field of Search ..... 110/341, 331, 332, 333, 110/334, 335; 29/469; 52/127.1, 127.2, 127.5, 745, DIG. 1; 269/243

[56] References Cited

U.S. PATENT DOCUMENTS

| | | | |
|---|---|---|---|
| 1,076,240 | 10/1913 | Schuffenhauer | 52/127.2 |
| 1,848,737 | 3/1932 | Matthews | 110/332 |
| 2,547,322 | 4/1951 | Heuer | 110/341 X |
| 2,930,601 | 3/1960 | Heuer | 110/331 X |
| 3,340,832 | 9/1967 | Grigsby | 110/341 X |
| 3,572,002 | 3/1971 | Nichols | 52/127.2 X |
| 4,463,689 | 8/1984 | James | 110/334 |

*Primary Examiner*—Edward G. Favors

*Attorney, Agent, or Firm*—Watson, Cole, Grindle & Watson

[57] ABSTRACT

A process for the assembly of at least one adjacent pair of component structural elements to form an upright vault structure, each of the elements having a recess, wherein the elements are arranged flat on the ground in the desired relative configuration and are temporarily joined together into an assembled unit by an assembly device, whereafter the device and the assembled unit are lifted and placed in a final position of the structure, and the joining device is removed from the elements. The joining device includes a post and a pair of opposed spaced jaw members mounted on the post for relative movement toward and away from one another, a pair of wing members being afixed to one of the jaw members, the wing members extending from opposite sides of this jaw member and toward the other of the jaw members and respectively engaging the recess of the structural elements. The jaw members are clamped together about the joined structural element.

7 Claims, 3 Drawing Figures

PROCESS FOR THE RAPID ASSEMBLY OF ELEMENTS COMPOSING A STRUCTURE

The invention relates to a process for the rapid assembly of elements composing a structure and to a device for temporarily maintaining such elements in the assembled position, useful in carrying out the said process.

The process of the invention has been developed for the construction of refractory vaults of regenerator chambers and basins of glass furnaces, but it can also be used for assembling the walls of regenerator chambers or furnaces when the height of the structure presents a problem.

The process of the invention could also be useful in the sector of civil-engineering construction in general.

In regenerators and basins of glass furnaces, the vaults consist of several arches placed side by side, each arch consisting of keyed refractory elements or blocks (also called keystones) which bear on the vertical walls by means of cushions.

At the present time, these vault arches are assembled with the use of a truss which serves as a template and a support for the keystones, the said truss itself resting on a previously erected scaffolding. The keystones of a particular arch are installed one after the other, with the use of wedges for adjustment purposes. Only when a vault arch is completely formed and holds firm because of the keying of the keystones is it possible to displace the truss and begin assembling the following arch. This method of construction obviously takes a long time and is consequently costly.

According to its broadest aspect, the subject of the invention is a process for the rapid assembly of at least two elements composing a structure, making it possible to do without the use of a scaffolding.

According to a particular aspect, the subject of the invention is a process for the rapid assembly of all the elements composing a vault arch, in particular for regenerator chambers or basins of glass furnaces.

According to another of its aspects, the subject of the invention is a device useful for carrying out the process of the invention, this device making it possible to maintain two adjacent component elements to be fitted, temporarily in their assembled position during the transport of these from the ground up to their final position.

More specifically, the invention relates to a process for the rapid assembly of at least two elements composing a structure, this process being defined in that it involves:

(a) arranging these component elements flat and on the ground in the desired relative configuration;

(b) joining these component elements together with the aid of suitable temporary-assembly means;

(c) lifting the unit formed by the assembled component elements with the aid of suitable lifting means and placing this unit in its final position in the structure; and, if necessary, (d) removing the temporary-assembly means.

According to a particular method of carrying out the process, the structure to be built is a vault arch, and stage (a) involves arranging flat and on the ground all the keystones composing the vault arch in the desired vault-arch configuration.

The elements composing the structure can be solid or hollow elements.

Various mechanical devices or even a glue can be used as temporary-assembly means. However, the applicant has invented the following special device which he has found entirely satisfactory and which, as a result of a few modifications, can be designed for assembling both solid elements and hollow elements.

According to the invention, this device comprises a post, two spaced jaws located opposite one another and carried by said post, at least one of these jaws being moveable, means of clamping the jaws on the elements to be held assembled and, integral with one of the said jaws, members projecting in the direction of the other jaw and designed to engage a recess provided in each element of a pair of adjacent elements to be held assembled.

According to a particular embodiment, the device consists of a fixed part in the general form of a right-angle bracket, one of the branches of the right-angle bracket forming a first jaw and the other branch forming a post, a second moveable jaw located opposite the first jaw and mounted to slide on said other branch of the right-angle bracket, means of clamping the jaws on the elements to be held assembled, and members which are integral with one of the jaws and projecting in the direction of the other jaw and which are designed to engage a recess provided in each of two adjacent elements to be held assembled.

The invention makes it possible not only to gain a considerably amount of time, but also to achieve a saving in terms of the costly scaffolding and template. Also, the component elements can be assembled on the ground with a precision which is generally higher than in the traditional method of construction.

The following description given with reference to the attached drawing will make it easy to understand the present invention. In this drawing:

FIGS. 1 and 2 illustrate how the process and device according to the invention are used to assemble a refractory vault arch.

Figure 1:
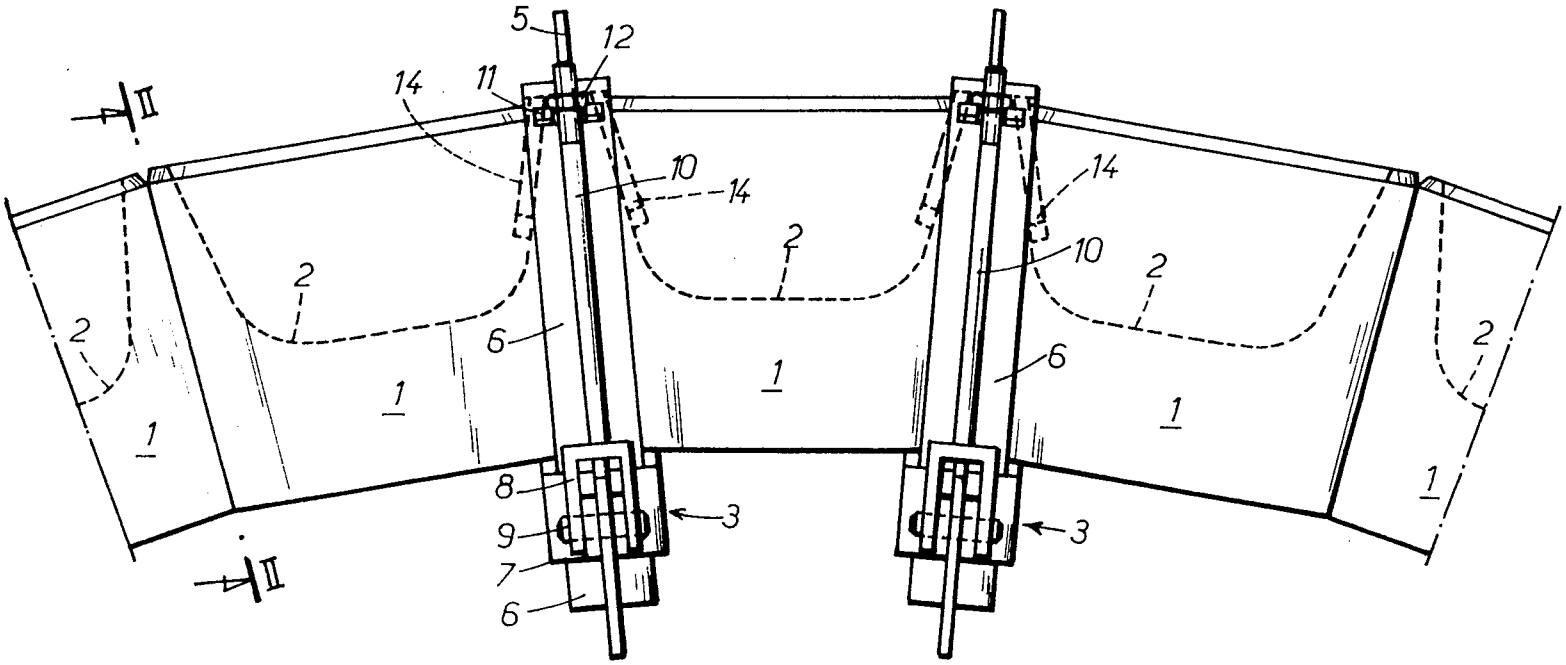
FIG. 1 is a plan view illustrating the use of the process and device according to the invention for assembling a refractory vault made of hollow keystones.

These figures show only part of a vault arch which actually consists of n keystones 1 made of refractory material. The keystones 1 are hollow at 2 in their upper part over some of their height, in order to make them lighter. Once the vault has been installed, such keystones are intended to be filled with an insulating refractory material. These keystones can consist, for example, of an electro-fused refractory material of the system $Al_2O_3$-$ZrO_2$-$SiO_2$ and, as an indication, can have the following dimensions (length: 300 mm, height 200 to 250 mm and width 300 mm). The recess 2 can extend over more than half the height of the keystone (for example, 140 mm for a height of 250 mm). According to the invention, the keystones 1 are arranged flat, side by side, in the relative position which they will occupy in the vault arch to be produced (FIG. 1). Once this has been done, the keystones are joined to one another in pairs by means of assembly devices designated by the reference numeral 3. Each device 3 is composed of a fixed part 4 in the general form of a right-angle bracket and consisting of a metal sectional piece with a T-shaped cross-section. One of the branches of the right-angle bracket forms a first jaw 5 whilst the other forms a post 6, on which is mounted a second jaw 7 located opposite the first jaw 5. The jaw 7 has a forked configuration grooved on the inside at its end located on the same side as the sectional post 6, so that it can be threaded onto the post and slide on it.

The jaws 5 and 7 are clamped against the elements or keystones to be held together in a very easy way by means of a screw-and-nut system. In fact, the jaw 7 is fixed, via a yoke 8 articulated about an axle 9, to a threaded rod 10 which passes through a lug 11 which is welded to the post 6 and on the end of which is screwed a nut 12 bearing on the lug 11. The screwing of the nut 12 makes it possible to clamp the jaws, as is obvious. The axle 9 passes throught a slot 13 provided in the lower part of the post in order to limit the stroke of the jaw 7. Moreover, the device also possesses two inclined wings 14 integral with the jaw 5. The inclination of these wings corresponds to the slope of the side of the recesses 2 of the keystones. Because of their inclination corresponding to the slope of the side of the recesses and because of their large surface, the wings come close up against the sides of the recesses and ensure that the keystones are retained perfectly, whilst at the same time distributing the forces and consequently preventing practically any risk of damage of the keystones which may result from excessive clamping. Finally, castellated notches, such as 15 and 16, are provided in the branches of the post for handling purposes. This device is very simple to use. When the keystones are positioned flat, as desired a device 3 is placed astride each joint between two adjacent keystones. For n keystones, it is therefore necessary to have n−1 devices 3 (only two devices are shown in FIG. 1 for the sake of a simple representation). Each device is put in place, with the nut 12 removed, so that the jaws can be moved apart sufficiently to allow the wings 14 to be introduced into recesses 2 in each pair of adjacent keystones. When this has been done, the screw 10 is, if necessary, rethreaded into the lug 11 and the nut 12 screwed, until the jaws clamp the keystones sufficiently to keep them assembled.

Once all the devices 3 have been clamped, a hook or a cable connected to a suitable lifting appliance (for example, a crane) is passed through the notch 15 in the central device 3 (or in two devices 3), so that the assembled vault arch can be brought into its position in the structure being built. The lifting operation is preferably carried out in two stages, that is to say the vault arch lying horizontally is first raised into an upright position, and then it is actually lifted. The castellated form of the notches makes it possible to select the point of engagement of the hook or cable on the vault arch, so as to present it in the appropriate assembly position on the cushions. Once the vault arch has been positioned on its cushions, the assembly devices 3 are dismantled. It is sufficient for this purpose, to unscrew the nuts 12 until the threaded rod 10 is released. The devices 3 can then be removed easily.

It should be noted that the same devices 3 can serve for maintaining in the assembled position a plurality of hollow refractory blocks of parallelepipedic, rather than keyed form. Such blocks are used to form the upper part of the walls of regenerator chambers. It is often difficult to instal these blocks in the conventional way because of the height at which they are located. The invention can achieve real progress in this respect.

In this case, since the recesses are located in the rear part of the refractory elements and not in their upper part, as they are in the keystones, and since the refractory elements are to be placed on elements previously positioned, the lifting means are secured via the notch 16 instead of the notch 15, so that the elements can be put in place without the assembly devices 3 impeding the laying operation. If desired, the various assembly devices 3 which are used can be fixed to one another by means of a metal bar or the like connecting them to one another, for example in the region of a notch, in order to increase the strenght of the assembly.

Figure 2:
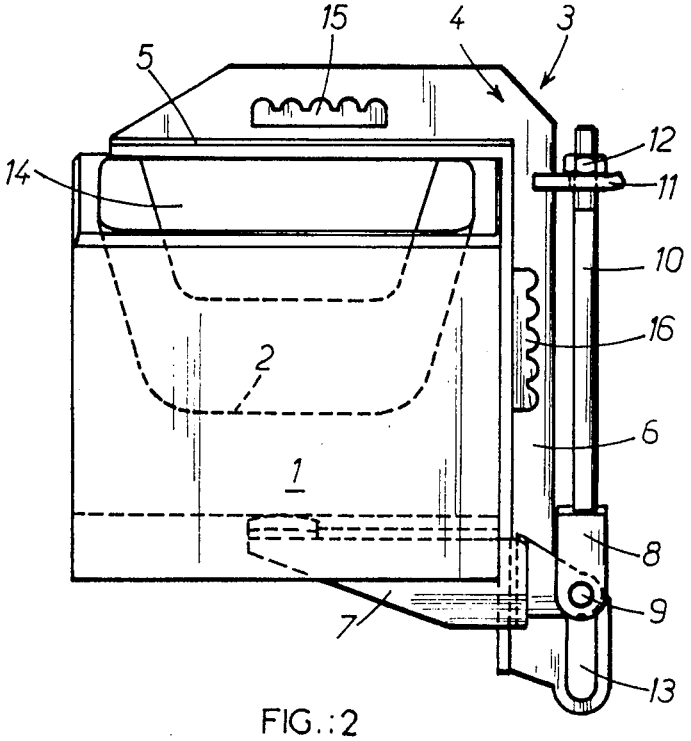
FIG. 2 is a side view of the unit in FIG. 1 along the line II—II.
Figure 3:
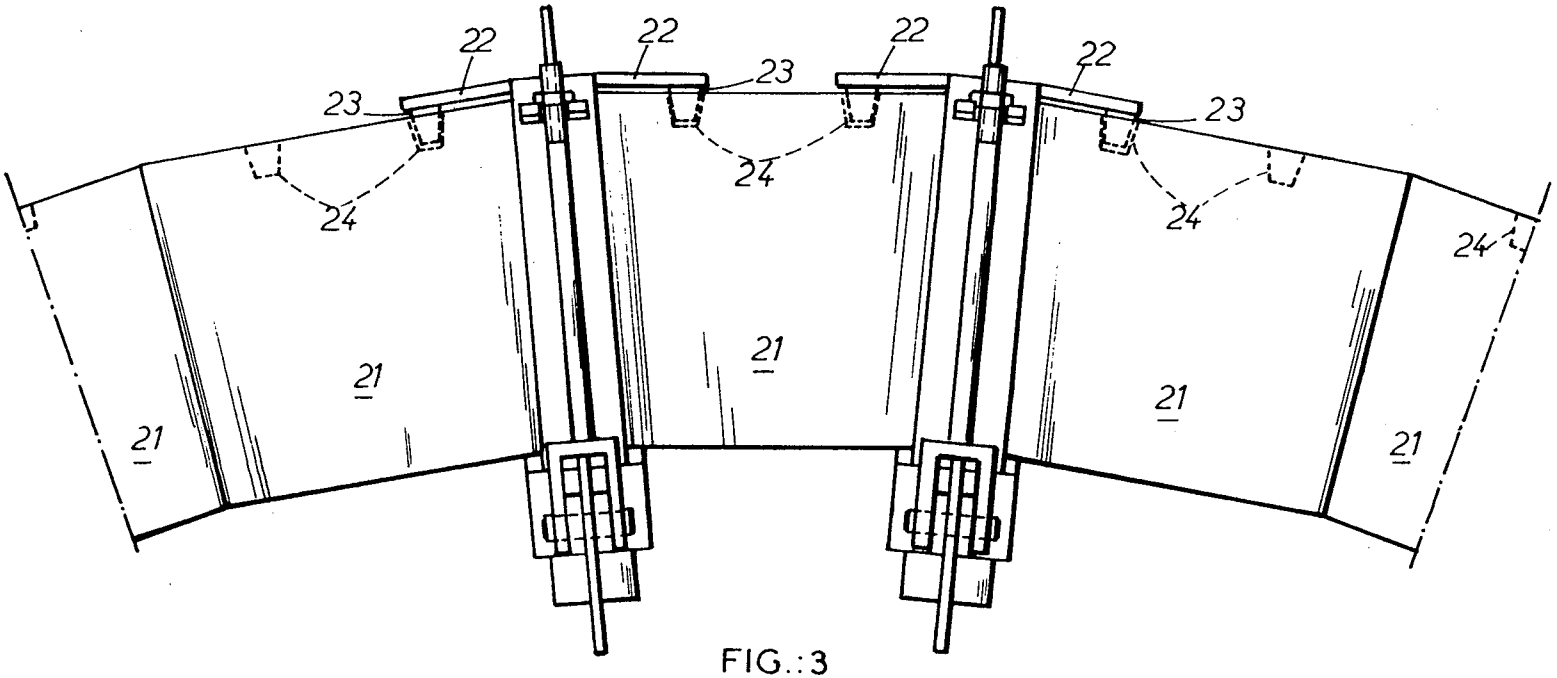
FIG. 3 is a plan view, similar to that of FIG. 1, illustrating and alternative embodiment suitable for assembling a refractory vault made of solid keystones.

FIG. 3 illustrates an alternative embodiment of the devices 3 which is designed for assembling solid refractory elements, such as keystones 21 composing a vault arch. In this alternative form, the inclined wings 14 are replaced by two wings 22, each of which is substantially parallel to the upper surface of the keystone over which it extends. These wings are provided with studs 23 which are directed downwards and which engage recesses or impressions 24 of matching shape formed in the upper part of the keystones. With the exception of this difference, the assembly devices and their use are as described in relation to FIGS. 1 and 2.

This alternative embodiment could also serve for assembling solid parallelepipedic refractory blocks, in a way similar to that described with reference to FIGS. 1 and 2.

It goes without saying that the embodiment described are only examples, and that they could be modified, particularly by the substitution of technical equivalents, without thereby departing from the scope of the invention.

I claim:

1. A process for the assembly of at least one adjacent pair of component structural elements to form an upright structure, each of said elements having a recess, comprising the steps of:

arranging said elements flat on the ground in the desired relative configuration;

temporarily joining together said elements side-by-side into an assembled unit by a device comprising a post, a pair of opposed, spaced jaw members mounted on said post for relative movement toward and away from one another, a pair of wing members affixed to one of said jaw members, said wing members extending from opposite sides of said one jaw member and toward the other of said jaw members, said wing members respectively engaging said recess of said elements, and means for clamping said jaw members together about said joined elements, lifting said device and said assembled unit and placing the same in a final position of the structure; and removing said device from said elements.

2. The process according to claim 1, wherein a first of said jaw members is interconnected with said post to form a right-angled bracket, the second of said jaw members being mounted for sliding movement on said post.

3. The process according to claim 1, wherein each said recess has a downwardly inclined wall, and said wing members are downwardly inclined to flatly engage each said wall.

4. The process according to claim 1, wherein said device has lift engageable means to facilitate said lifting.

5. The process according to claim 4, wherein said lift engageable means comprises at least one castellated notch.

6. The process according to claim 1, wherein said structure comprises a vault arch, and said elements comprise keystones forming said arch.

7. The process according to claim 6, wherein said recesses are located in the upper ends of said keystones.

* * * * *